US007296614B2

(12) United States Patent
Schlichting et al.

(10) Patent No.: US 7,296,614 B2
(45) **Date of Patent: *Nov. 20, 2007**

(54) METHOD AND APPARATUS FOR CONTROLLING THE FORMATION OF CROCODILE SKIN SURFACE ROUGHNESS ON THIN CAST STRIP

(75) Inventors: Mark Schlichting, Crawfordsville, IN (US); Joel D. Sommer, Crawfordsville, IN (US); Shiro Osada, Kanagawa (JP); Hisahiko Fukase, Tokyo (JP)

(73) Assignee: Nucor Corporation, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/302,484

(22) Filed: Dec. 13, 2005

(65) Prior Publication Data

US 2006/0144554 A1 Jul. 6, 2006

Related U.S. Application Data

(63) Continuation-in-part of application No. 11/010,625, filed on Dec. 13, 2004, now abandoned.

(51) Int. Cl.
*B22D 11/06* (2006.01)

(52) U.S. Cl. ..... 164/480; 164/428

(58) Field of Classification Search ..... 164/479–482, 164/428–429, 431–432
See application file for complete search history.

(56) References Cited

U.S. PATENT DOCUMENTS 3,345,738 A 10/1967 Mizikar et al.
3,795,025 A 3/1974 Sadamitsu
4,250,950 A 2/1981 Buxmann et al.
4,530,597 A 7/1985 Itaya et al.
4,793,400 A 12/1988 Wood
4,934,443 A 6/1990 Honeycutt et al.

(Continued)

FOREIGN PATENT DOCUMENTS

EP 0 409 645 1/1991

(Continued)

OTHER PUBLICATIONS

International Search Report for PCT/IB2005/054225.

(Continued)

*Primary Examiner*—Kuang Y. Lin
(74) *Attorney, Agent, or Firm*—Hahn Loeser & Parks LLP; Arland T. Stein

(57) ABSTRACT

A method of controlling the formation of crocodile skin surface roughness on thin cast strip of plain carbon steel forming a casting pool of molten metal of plain carbon steel of less than 0.065% carbon supported on a casting surfaces above a nip, assembling a rotating brush to contact the casting surfaces in advance of contact with the molten metal, and controlling the energy exerted by rotating brushes against the casting surfaces of the casting rolls to clean and expose a majority of the projections of the casting surfaces of the casting rolls by provide wetting contact with the molten metal of the casting pool. The cleaning step may be done by controlling the energy of the rotating brush against the casting rolls based on the difference between the measured heat flux and the initially measured heat flux when the casting surfaces are clean, and automating the method.

31 Claims, 12 Drawing Sheets

U.S. PATENT DOCUMENTS

| | | | |
|---|---|---|---|
| 5,307,861 | A | 5/1994 | Townsend |
| 5,575,327 | A | 11/1996 | Kato |
| 5,590,701 | A | 1/1997 | Fukase |
| 5,651,413 | A | 7/1997 | Williams et al. |
| 5,660,224 | A | 8/1997 | Barbe et al. |
| 5,787,967 | A | 8/1998 | Vendeville et al. |
| 5,965,277 | A | 10/1999 | Banthia et al. |
| 2002/0088602 | A1 | 7/2002 | Kato et al. |
| 2002/0166653 | A1 | 11/2002 | Yamamura et al. |

FOREIGN PATENT DOCUMENTS

| | | | |
|---|---|---|---|
| EP | 0714716 | | 5/1996 |
| EP | 0 865 850 | | 9/1998 |
| EP | 0 887 145 | | 12/1998 |
| FR | 2 771 034 | | 5/1999 |
| JP | 3-230849 | | 10/1991 |
| JP | 08-29401 | B | 3/1996 |
| JP | 29393 | | 2/1997 |
| JP | 29394 | | 2/1997 |
| JP | 2001-58245 | | 3/2001 |
| JP | 2002-113555 | | 4/2002 |
| JP | 2002-210544 | | 7/2002 |
| JP | 5-177311 | | 7/2006 |
| KR | 2003 052333 | | 6/2003 |
| WO | 9402269 | | 3/1994 |
| WO | 03/055624 | | 7/2003 |
| WO | 2004/065039 | | 8/2004 |

OTHER PUBLICATIONS

Written Opinion for PCT/IB2005/054225.
International Search Report for PCT/IB2005/054226.
Written Opinion for PCT/IB2005/054226.

METHOD AND APPARATUS FOR CONTROLLING THE FORMATION OF CROCODILE SKIN SURFACE ROUGHNESS ON THIN CAST STRIP

RELATED APPLICATION

This application is a continuation-in-part of application Ser. No. 11/010,625, filed Dec. 13, 2004, now abandoned.

BACKGROUND AND SUMMARY OF THE INVENTION

This invention relates to the casting of steel strip by a single or a twin roll caster. In a twin roll caster, molten metal is introduced between a pair of counter-rotated horizontally positioned casting rolls, which are internally cooled so that metal shells solidify on the moving roll surfaces and are brought together at the nip between them to produce a thin cast strip product delivered downwardly from the nip. The term "nip" is used herein to refer to the general region at which the rolls are closest together. The molten metal may be poured from a ladle into a smaller vessel, from which it flows through a metal delivery nozzle located above the nip forming a casting pool of molten metal supported on the casting surfaces of the rolls. This casting pool is usually confined between side plates or dams held in sliding engagement with end surfaces of the rolls so as to dam the two ends of the casting pool against outflow.

When casting steel strip in a twin roll caster, the casting pool will generally be at a temperature in excess of 1550° C., and usually 1600° C. and greater. It is necessary to achieve very rapid cooling of the molten steel over the casting surfaces of the rolls in order to form solidified shells in the short period of exposure on the casting surfaces to the molten steel casting pool during each revolution of the casting rolls. Moreover, it is important to achieve even solidification so as to avoid distortion of the solidifying shells which come together at the nip to form the steel strip. Distortion of the shells can lead to surface defects known as "crocodile skin surface roughness." Crocodile skin surface roughness is known to occur with high carbon levels above 0.065%, and even with carbon levels below 0.065% by weight carbon. Crocodile skin roughness, as illustrated in FIG. 1, is known to occur for other reasons. Crocodile skin roughness involves periodic rises and falls in the strip surface of 40 to 80 microns, in periods of 5 to 10 millimeters, measured by profilometer.

We have found that with carbon levels below 0.065% by weight the formation of crocodile skin surface roughness is directly related to the heat flux between the molten metal and the surface of the casting rolls, and that the formation of crocodile skin roughness can be controlled by controlling the heat flux between the molten metal and the surface of the casting rolls. FIG. 2 reports dip tests that illustrates the relationship between the heat flux and the formation of crocodile skin roughness during the formation of the metal shells on the surfaces of the casting rolls in making the thin cast strip. As shown by FIG. 2, we have also found that by controlling the energy exerted by rotating brushes peripherally in contact with the casting surfaces of each casting roll, in advance of contact of the casting surface with the molten metal, that the heat flux between the molten metal and the surface of the casting rolls, and in turn crocodile skin surface roughness on the resulting thin cast strip can be controlled.

This relationship between the heat flux from the molten metal and the surface of the casting rolls and the formation of crocodile skin surface roughness on the thin cast strip has been found to occur whether the casting roll surfaces are smooth or textured. FIG. 3 reports dip tests that illustrate how the heat flux is changed with both smooth and textured casting surfaces on the casting rolls. We have also found that the texture of the casting roll surfaces of the casting rolls change during casting. This change can cause a change in heat flux from the molten metal to the casting roll surfaces and in turn a change in formation of crocodile skin surface roughness on the thin cast strip. We have found a method of directly controlling the formation of crocodile skin surface roughness by controlling the heat flux between the molten metal and the casting roll surfaces, to avoid high fluctuations in the heat flux during the formation of the metal shells during casting and in turn control the forming of crocodile skin surface roughness in the thin cast strip produced.

The method of controlling the formation of crocodile skin surface roughness in continuous casting of thin cast strip of plain carbon steel is disclosed that comprises the steps of:

assembling a pair of counter-rotating casting rolls laterally to form a nip between circumferential casting surfaces of the rolls through which metal strip may be cast;

forming a casting pool of molten metal of plain carbon steel of less than 0.065% by weight carbon supported on the casting surfaces of the casting rolls above the nip;

assembling a rotating brush peripherally to contact the casting surface of each casting roll in advance of contact of the casting surfaces with the molten metal in the casting pool;

forming a desired degree of cleaning of the casting surfaces of the casting rolls with a majority of projections on the casting surfaces exposed and provide wetting contact between the casting surface and the molten metal of the casting pool by controlling the energy exerted by the rotating brushes during a casting campaign;

controlling the energy exerted by the rotating brushes against the casting surfaces of the casting rolls using the desired degree of cleaning as a reference to clean the expose a majority of projections of the casting surfaces of the casting rolls and provide wetting contact between the casting surface and the molten metal of the casting pool; and counter-rotating the casting rolls such that the casting surfaces of the casting rolls each travel toward the nip to produce a cast strip downwardly from the nip.

The casting surfaces of the casting rolls may be textured with projections, and the cleaning of the casting surfaces of the casting rolls maintains a majority of extended portions of said projections exposed for contact with the molten metal of the casting pool. These exposed projections of the casting surface, however, may be about one-twentieth or one-thirtieth, or less, of the surface area of the casting surface. There is still residual material, including metal and oxides, in the "valleys," entices and other low areas of the casting surfaces, as opposed to the raised areas of the casting surfaces. More specifically, the casting surfaces of the casting rolls may be textured with a random distribution of discrete projections as described and claimed in application Ser. No. 10/077,391, filed Feb. 15, 2002 and published Sep. 12, 2002, as US 2002-0124990, the disclosure of which is incorporated by reference.

In any event, a substantial portion of the casting surface is exposed by the cleaning of the casting surfaces so that there can be wetting of the casting surface by the molten metal when the casting surface is rotated into contact with the casting pool. Cleaning here does not mean the casting surfaces are completely clean of all contaminates. Clean here means that the parts of the casting roll surfaces that are exposed, the projections, are substantially free from matter that adulterates or contaminates wetting of the casting surfaces by the molten metal and inhibits effective heat flux from the molten metal to the casting surfaces. It is not necessary or practical for the brushes to clean all exposed projections of the casting surface. Clean means that the exposed casting surfaces are sufficiently clean that the formation of crocodile skin roughness is inhibited, if not eliminated. FIGS. 9 through 11 illustrate cleaning of the casting surface to expose a majority of the projections of the surface in accordance with this invention.

The energy exerted by the cleaning brush against the casting surface of the casting roll is determined by the pressure by the brush against the casting surface and the speed of rotation of the brush and the casting speed. This may be done, for example, by measuring the throughput and/or the differential pressure of hydraulic fluid through hydraulic motors, which power the brushes cleaning the casting surfaces of the casting rolls. This may be done manually or by automated controls, and as explained below automated controls have provided the best mode contemplated of the invention.

Alternatively, a method of controlling the formation of crocodile skin surface roughness in continuous casting of thin cast strip of plain carbon steel is disclosed that comprises the steps of:

assembling a pair of counter-rotating casting rolls laterally to form a nip between circumferential casting surfaces of the rolls through which metal strip may be cast;

forming a casting pool of molten metal of plain carbon steel of less than 0.065% by weight carbon supported on the casting surfaces of the casting rolls above the nip;

assembling a rotating brush using hydraulic motors peripherally to contact the casting surface of each casting roll in advance of contact of the casting surfaces with the molten metal in the casting pool;

setting a desired degree of cleaning of the casting surfaces of the casting rolls with a majority of projections on the casting surfaces exposed and provide wetting contact between the casting surface and the molten metal of the casting pool by controlling the energy exerted by the rotating brushes during a casting campaign;

monitoring the torque of the hydraulic motors to control the energy exerted by the rotating brushes against the casting surfaces of the casting rolls using the desired degree of cleaning as a reference to clean the expose a majority of projections of the casting surfaces of the casting rolls and provide wetting contact between the casting surface and the molten metal of the casting pool; and counter-rotating the casting rolls such that the casting surfaces of the casting rolls each travel toward the nip to produce a cast strip downwardly from the nip.

The torque of the hydraulic motors may be monitored by measuring the pressure differential between inlet and outlet of hydraulic fluid through the hydraulic motors. Alternatively, the torque of the hydraulic motors may be monitored by measuring the torque between the hydraulic motor and a chock or a motor mount. The energy of the rotating brush against the casting roll may also be controlled by varying the rotation speed of the brush against the casting surface of the casting roll. In any event, the monitoring of the torque of the hydraulic motors, and in turn the energy exerted by the bushes against the casting surfaces, may be controlled manually or by automated controls, but the automated controls provide the best mode of performing the invention as explained by for example below.

The casting surfaces of the casting rolls may be textured projections, and in addition may be with a random distribution of discrete projections.

In an alternative, the method of controlling the formation of crocodile skin surface roughness in continuous casting of thin-cast strip may comprise the steps of:

assembling a pair of counter-rotating casting rolls laterally to form a nip between circumferential casting surfaces of the rolls through which metal strip may be cast;

forming a casting pool of molten metal of plain carbon steel of less than 0.065% by weight carbon supported on the casting surfaces of the casting rolls above the nip;

assembling a rotating brush peripherally capable of contacting the casting surface of each casting roll in advance of contact of the casting surfaces with the molten metal;

forming clean bands exposing a majority of the projections of the casting surfaces of the casting rolls as reference for controlling the pressure exerted by the rotating brushes against the casting surfaces of the casting rolls;

controlling the energy of the rotating brush against the casting rolls using the clean band as a reference to clean the casting surfaces; and counter-rotating the casting rolls such that the casting surfaces of the casting rolls each travel toward the nip to produce a cast strip downwardly from the nip.

The casting surfaces, of which the clean bands are a part, are typically textured. The casting surfaces have a majority of extended portions of said projections exposed for contact with the molten metal of the casting pool. However, the exposed surfaces of the clean bands are still a minor part of the area of the casting surfaces of the casting rolls. There is still residue in the "valleys," entices and other low areas of the clean bands (as opposed to the raised areas of the clean bands) which may be the majority of the surface area. More specifically, again, the casting surfaces of the casting rolls may be textured with a random distribution of discrete projections as described and claimed in application Ser. No. 10/077,391, filed Feb. 15, 2002 and published Sep. 12, 2002, as US 2002-0124990, the disclosure of which is incorporated by reference. In any event, again, the exposed surface is not the majority of the casting surfaces or the clean bands thereof.

However, a substantial portion of the casting surface is exposed by the cleaning of the casting surfaces so that they can be wetted of the casting surface by the molten metal when the casting surface is rotated into contact with the casting pool. Further, clean here means that the parts of the casting roll surfaces that are exposed are substantially free from matter that adulterates or contaminates wetting of the casting surfaces by the molten metal, and inhibits effective heat flux from the molten metal to the casting surfaces. However, again, it is not necessary or practical for the brushes to clean all exposed projections of the casting surface. Again, clean means that the exposed casting surfaces are sufficiently clean that the formation of crocodile skin roughness is inhibited, if not eliminated. Again, FIGS. 9 and 11 illustrate cleaning of the casting surfaces to expose a majority of projections of the surfaces in accordance with this invention.

As before, the energy exerted by the cleaning brush against the casting surface of the casting roll is determined by the pressure by the brush against the casting surface and the speed of rotation of the brush and the casting speed. This can be measured and controlled by the flow of hydraulic fluid through a hydraulic motor driving rotation of the brush and in turn the speed of rotation of the brushes, and/or by pressure differential hydraulic fluid across the hydraulic motors driving the brushes, and in turn the torques of the hydraulic motors and the pressure exerted by the brushes against the casting surfaces of the casting rolls.

A further alternative, the method of controlling the formation of crocodile skin surface roughness in continuous casting of thin-cast strip of plain carbon steel comprising the steps of:

assembling a pair of counter-rotating casting rolls laterally to form a nip between circumferential casting surfaces of the rolls through which metal strip may be cast;

forming a casting pool of molten metal of plain carbon steel of less than 0.065% by weight carbon supported on the casting surfaces of the casting rolls above the nip;

assembling a rotating brush peripherally to contact the casting surface of each casting roll in advance of contact of the casting surfaces with the molten metal capable of cleaning residual from the surface of the casting roll;

cleaning to expose the majority of projections of the casting surfaces of the casting rolls and initially measuring the heat flux from the molten metal to the cleaned casting surfaces;

continually measuring the heat flux from the molten metal to the casting surfaces of the casting rolls;

controlling the energy exerted by the rotating brush against the casting rolls based on the difference between said measured heat flux and the initially measured heat flux between the molten metal and the casting surfaces; and counter-rotating the casting rolls such that the casting surfaces of the casting rolls each travel toward the nip to produce a cast strip downwardly from the nip.

This alternative has the advantage that the initial heat flux measured provides the reference for the clean casting surfaces of the casting rolls cleaned, as above described to serve as the reference for cleaning throughout the casting campaign. The same effective cleaning of the casting surfaces can thus be controlled and maintained through the casting campaign. In turn, the cleaning of the casting surfaces can be monitored and controlled indirectly by controlling the energy exerted by rotating brush against the casting rolls either manually or automatically as explained in detail by example below.

The energy of the rotating brush against the casting roll may be in turn controlled based on the casting speed by varying the application pressure or the speed of rotation, or both, of an electric, pneumatic or hydraulic motor rotating the brush against the casting surface. The energy of the rotating brush can be measured by measuring the torque of the motor rotating. The heat flux between the molten metal and the casting surfaces of the casting rolls may be initially measured and continually measured, as well as the difference between the real time heat flux and the initial heat flux measured, by measuring the difference in temperature of the cooling water circulated through the casting roll between the inlet and outlet as described in U.S. Pat. Nos. 6,588,493 and 6,755,234. Still it is contemplated that the heat flux can be measured by any available method. In any event, by monitoring the heat flux and calculating the difference in heat flux from the initial heat flux measured, the energy exerted by the brush against the casting surface can be automatically controlled by a control system that receives electrical signals from the monitor corresponding to the measured heat flux, and controls the energy exerted by the brush against the casting roll based on the difference in heat flux from the initial heat flux measured.

In addition, the method of controlling the formation of crocodile skin surface roughness in continuous casting of thin-cast strip may include the additional step of:

controlling the pressure of the gas blown through ports onto the casting surfaces of the casting rolls based on the difference between said measured heat flux and an initially measured heat flux between the molten metal and the casting surfaces to assist in controlling the formation of crocodile skin surface roughness in continuous casting of thin-cast strip.

Plain carbon steel for purpose of the present invention is defined as less than 0.065% carbon, less than 10.0% silicon, less than 0.5% chromium, less than 2.0% manganese, less than 0.5% nickel, less than 0.25% molybdenum, and less than 1.0% aluminum, together with other elements such as sulfur, oxygen and phosphorus which normally occur in making carbon steel by electric arc furnace. Low carbon steel may be used in these methods having a carbon content in the range 0.001% to 0.1% by weight; a manganese content in the range 0.01% to 2.0% by weight; and a silicon content in the range 0.01% to 10.0% by weight. The steel may have an aluminum content of the order of 0.01% or less by weight. The aluminum may, for example, be as little as 0.008% or less by weight. The molten steel may be a silicon/manganese killed steel.

BRIEF DESCRIPTION OF THE DRAWINGS

In order that the invention may be more fully explained, particular embodiments will be described in detail with reference to the accompanying drawings in which.

DETAILED DESCRIPTION OF THE DRAWINGS

Figure 1:
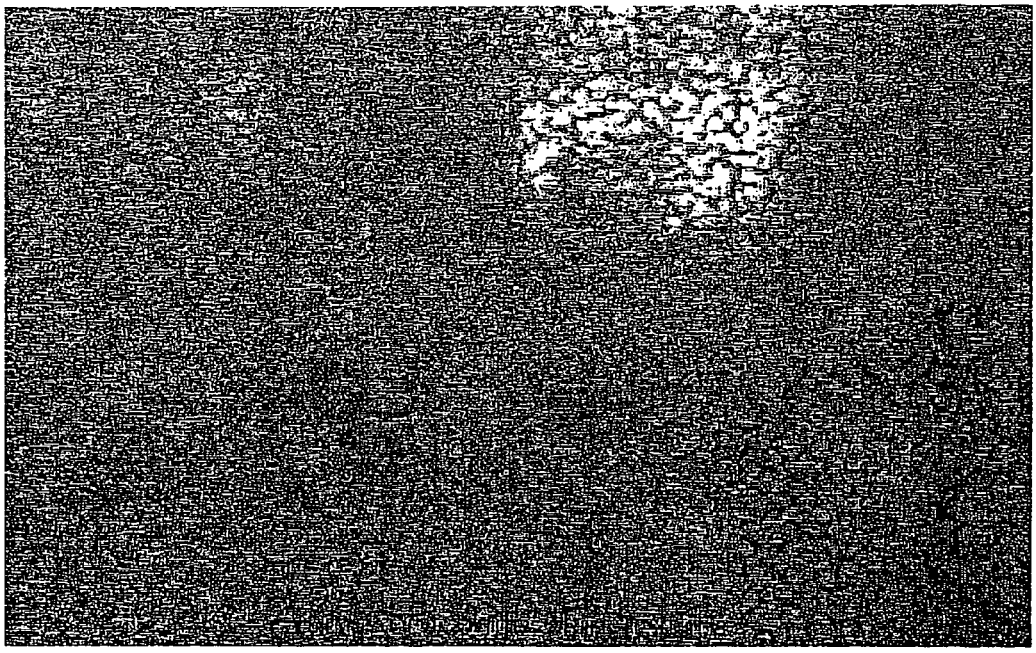
FIG. 1 is a micrograph showing crocodile skin surface roughness controlled by the present invention.
Figure 2:
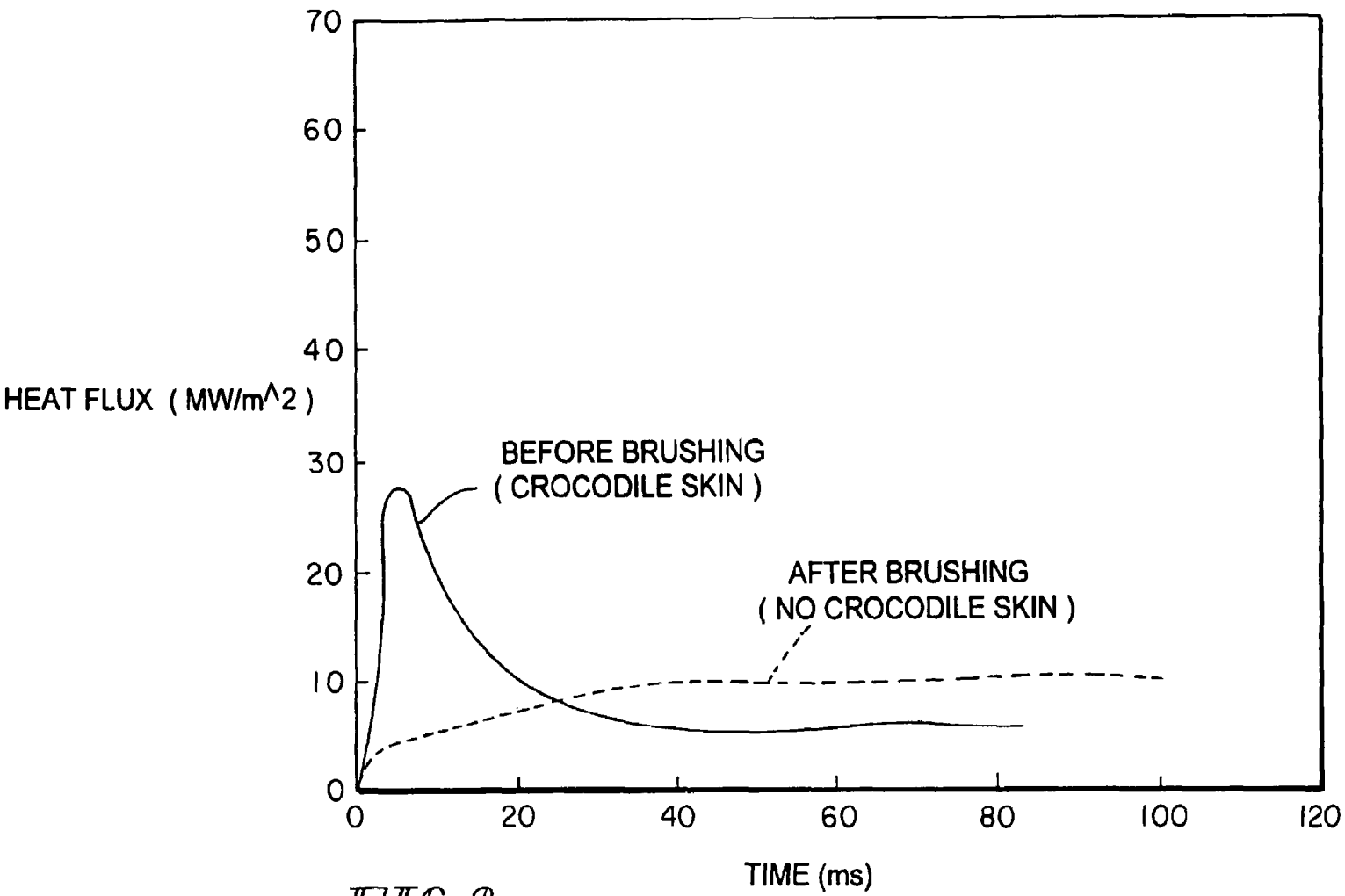
FIG. 2 is a graph illustrating the relationship between controlling heat flux and controlling the formation of crocodile skin surface roughness.
Figure 3:
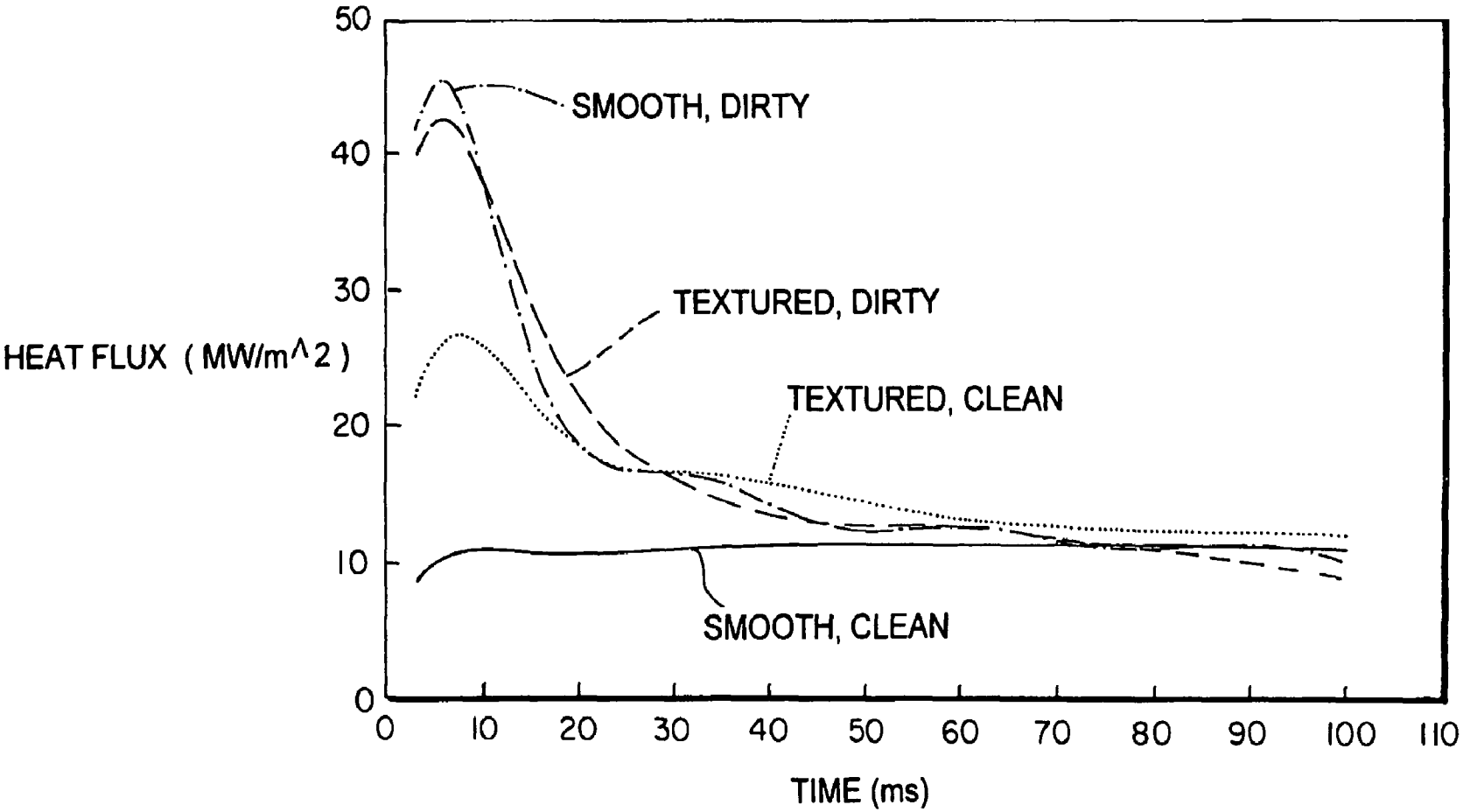
FIG. 3 is a graph illustrating the relationship between controlling heat flux and controlling the formation of crocodile skin surface roughness with smooth and textured casting roll surfaces.

The embodiments are described with reference to a twin roll caster in FIGS. 4 through 8. The illustrated twin roll caster comprises a main machine frame 11 which supports a pair of parallel casting rolls 12 of generally textured outer peripheral casting surfaces 12A. Molten metal of plain carbon steel of less than 0.065% by weight carbon is supplied during a casting operation from a ladle 13 through a refractory ladle outlet shroud 14 to a tundish 15, and from there, through a metal delivery nozzle 16 (also called a core nozzle) between the casting rolls 12 above the nip 17. Hot metal thus delivered forms a molten metal casting pool 10 above the nip 17 supported on the casting surfaces 12A. This pool 10 is confined at the ends of the rolls by a pair of side closure or side dam plates 18 which may be held against stepped ends of the casting rolls 12 by actuation of a pair of hydraulic cylinder units (not shown). The upper surface of the pool 10 (generally referred to as the "meniscus" level) may rise above the lower end of the delivery nozzle 16 so that the lower end of the delivery nozzle is immersed within the pool.

Casting rolls 12 are water cooled so that shells solidify on the casting surfaces 12A as the casting surfaces move in contact with the casting pool 10. The casting surfaces may textured, for example, with a random distribution of discrete projections as described and claimed in application Ser. No. 10/077,391, filed Feb. 15, 2002 and published Sep. 12, 2002, as US 2002-0124990. The shells are brought together at the nip 17 between the casting rolls to produce a solidified thin cast strip product 19 at the nip 17. This thin cast product 19 may be fed, typically with further processing, to a standard coiler (not shown).

The illustrated twin roll caster as thus far described is of the kind which is illustrated and described in some detail in our Australian Patent 631728 and our U.S. Pat. No. 5,184,668, both being incorporated by reference. Reference may be made to those patents for appropriate constructional details which form no part of the present invention.

A pair of roll brushes denoted generally as 21 is disposed adjacent the pair of casting rolls such that they may be brought into contact with the casting surfaces 12A of the casting rolls 12 at opposite sides of nip 17 prior to the casting surfaces 12A coming into contact with the molten metal casting pool 10.

Each brush apparatus 21 comprises a brush frame 20 which carries a main cleaning brush 22, for cleaning the casting surfaces 12A of the casting rolls 12 during the casting campaign, and optionally, a separate sweeper brush 23 cleaning the casting surfaces 12A of the casting rolls 12 at the beginning and end of the casting campaign. The main cleaning brush 22 may be segmented, if desired, but is generally one brush extending across the casting roll surface of 12A of each casting roll 12. Frame 20 may comprise a base plate 41 and upstanding side plates 42 on which the main cleaning brush 22 is mounted. Base plate 41 may be fitted with slides 43 which are slidable along a track member 44 to allow the frame 20 to be moved toward and away from one of the casting rolls 12, and thereby move the main brush 22 mounted on the frame 20 by operation of the main brush actuator 28. A sweeper brush 23, if present, may be mounted on frame 20 to move independently of the main brush 22 by operation of sweeper brush actuator 28A from retracted positions to operative positions in contact with the casting surfaces 12A of the casting rolls 12, so that either the sweeper brush 23 or the main brush 22, or both, may be brushing the casting surfaces of the casting rolls without interruption in the brushing operation between them.

What is important is that the energy exerted by the cleaning brush 22 against the casting surfaces 12A of the casting rolls 12 is controlled so that the cleaning of the casting roll surfaces is maintained at a specified level during the casting campaign, and in turn formation of crocodile skin roughness on the thin cast strip is controlled. The energy exerted by the brush on the casting surface 12A is controlled by controlling the pressure of the brush on the casting rolls, or the rotational speed of the cleaning brush 22, or both, based on measurement of the heat flux from the molten metal in the casting pool 10 to the casting surfaces 12A of the casting rolls 12. This pressure and rotational speed will be varied according to the casting speed during the casting campaign. This control may be done manually or automatically as described in the invention.

The method may be practiced by controlling the energy exerted by the rotating brush to maintain the casting surfaces 12A of the casting rolls 12 clean, as above described, during the casting campaign. This may be done by cleaning to expose a majority of the projections of the casting surfaces of the casting rolls 12, and measuring this initial heat flux between the molten metal and the casting rolls. The heat flux is then continually measured in real time either continuously or intermittently during the casting campaign, and then the difference between the real time heat flux and the initial heat flux measured, to control the energy exerted by the cleaning brush 22 on the casting roll surfaces 12A of the casting rolls 12. The heat flux, both initially and in real time, can be measured by measuring the difference in temperature of the cooling water circulated through the casting rolls between the inlet and outlet as described in U.S. Pat. Nos. 6,588,493 and 6,755,234. Still, it is contemplated that the heat flux can be measured by any available method.

The initial measured heat flux is related to the desired degree of cleaning of the casting roll surfaces 12A, as above described, to control the formation of crocodile skin roughness during the casting campaign. The continual measured heat flux in real time, and the difference between the initial heat flux and the real time heat flux measured, is used to control the energy exerted by the cleaning brush on the casting surfaces 12A so that cleaning of the casting roll surfaces 12A is controlled, and in turn, the formation of crocodile skin roughness on the surface of the cast strip controlled.

The method can thus be automated by providing a control system (not shown) responsive to sensors monitoring the heat flux, calculating the difference in heat flux from the initial heat flux measured, and controlling the energy exerted by the brush against the casting surface based in the difference in heat flux from the initially heat flux measured. The cleaning brush 22, the main cleaning brush, may be in the form of a cylindrical barrel brush having a central body 45 carried on a shaft 34 and fitted with a cylindrical canopy of wire bristles 46. Shaft 34 may be rotatably mounted in bearings 47 in the side plates 42 of frame 20, and a hydraulic, pneumatic, or electric drive motor 35 may be mounted on one of these side plates coupled to the brush shaft 34 so as to rotatably drive the cleaning brush 22 in the opposite direction of the rotation of the casting surfaces 12A of casting roll 12. Although the main brush 22 is shown as a cylindrical barrel brush, it should be understood that this brush may take other forms such as the elongate rectangular brush disclosed in U.S. Pat. No. 5,307,861, the rotary brushing devices disclosed in U.S. Pat. No. 5,575,327 or the pivoting brushes of Australian Patent Application PO7602.

The precise form of the main brush is not important to the present invention. What is important is that the energy exerted by the cleaning brush against the casting surfaces capable of being controlled so the cleaning of exposed casting surface of the casting rolls 12 is controlled throughout the casting campaign and, in turn, formation of crocodile skin surface roughness of the cast strip is controlled. The energy exerted by cleaning brush 22 against the casting surface 12A of the casting roll 12 may be controlled by controlling the application pressure or the speed of rotation, or both, of an electric, pneumatic or hydraulic motor rotating the brush coordinated with the casting speed. The energy, pressure or rotation speed of the rotating brush can be measured by measuring the torque of the motor rotating.

The rotational speed of the cleaning brush 22 can be measured, for example, by a flow meter measuring the flow of hydraulic fluid through a hydraulic motor driving the rotating cleaning brush 22. The torque of the motor may be monitored by measuring the pressure differential between inlet and outlet of hydraulic fluid through the hydraulic motors. Alternatively, the torque of the motors, hydraulic, electric or pneumatic, may be monitored by measuring the torque with a strain gauge, load cell or other device between the hydraulic motor and mount for bearings 47 (i.e., chock) or other convenient part of the motor mount structure.

Figure 5:
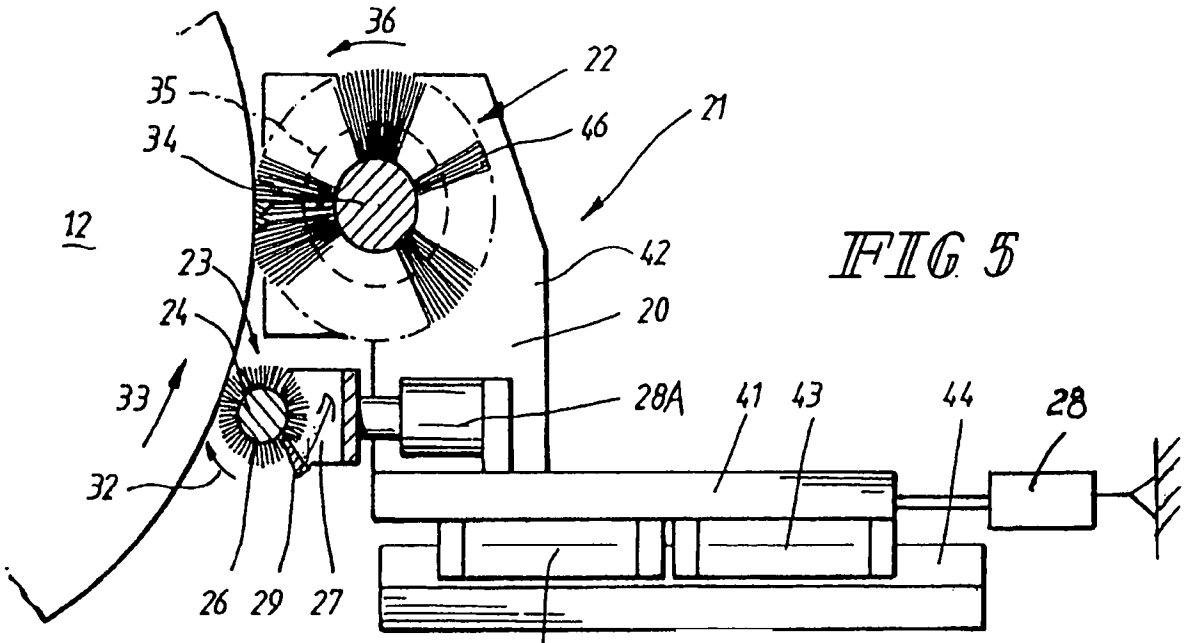
FIG. 5 illustrates one of the brushing apparatus.
Figure 7:
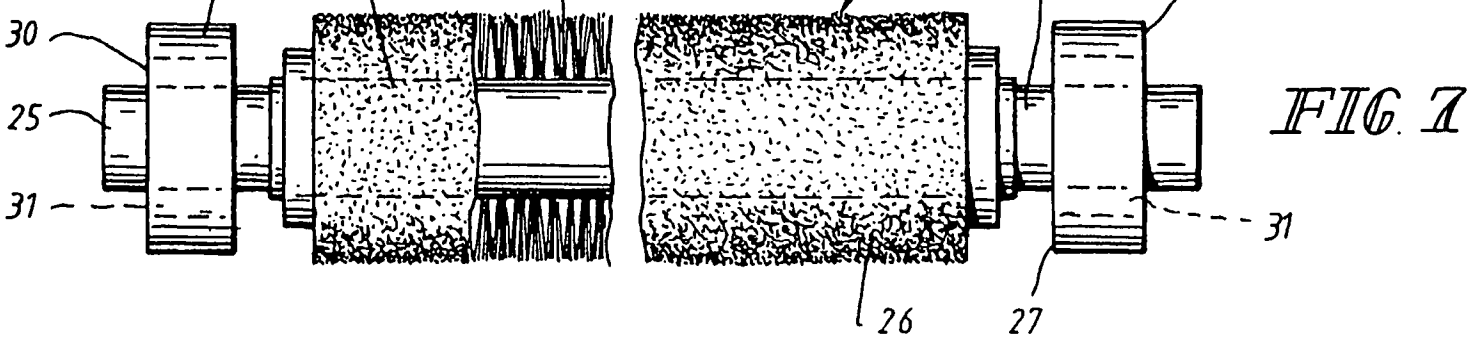
FIG. 7 is a front elevation of a sweeper brush of the brushing apparatus.
Figure 6:
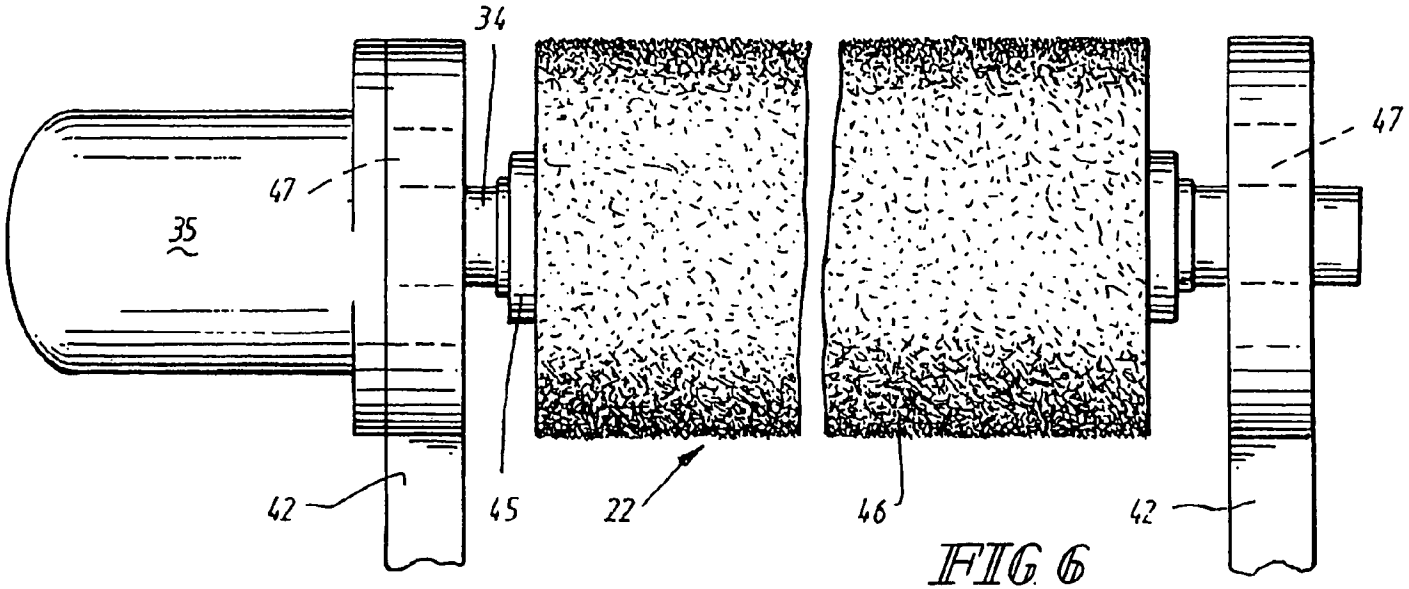
FIG. 6 is a front elevation of a main brush of the brushing apparatus.

Although the main cleaning brush 22 may be driven in a direction counter to the rotation of the casting roll, the main brush 22 is usually driven in the same rotational direction 33 as the casting rolls, as indicated by the arrow 36 in FIG. 5. Note means that the casting surface 12A is moving in a direction opposite to the movement of the bristles of the brush 22 against the casting surface of the casting roll.

If used, the separate sweeper brush 23, which is peripherally involved in use of the best mode of the invention contemplated, may be in a form of a cylindrical barrel brush which is mounted on frame 20 so as to be moveable on the frame such that it can be brought into engagement with the casting surface 12A of casting roll 12, or retracted away from that the casting surface 12A by operation of the sweeper brush actuator 28A independent of whether the main brush 22 is engaged with the casting surfaces 12A of casting roll 12. This enables the sweeper brush 23 to be moved independently of the main brush 22 and brought into operation only during the start and finish of a casting run and be withdrawn during normal casting as described below. The sweeper brush 23 may be rotatably driven in tandem with or independently of the main brush 22. The sweeper brush 23 may also be driven in the same direction as the casting surfaces 12A of casting rolls 12 at a speed different from the speed of the casting rolls 12. In this way, the large accretions that can occur at the start and end of the casting run are less likely to be dragged across the casting surfaces 12A and cause scoring of the casting surfaces 12A, where the sweeper brush 23 is contacting the casting surfaces 12A and moving in the direction opposite the casting surface.

If used, sweeper brush 23 may have a central body 24 carried on a shaft 25 and fitted with a cylindrical canopy of wire bristles 26. The brush shaft 25 may be rotatably mounted in a brush mounting structure 27 which can be moved back and forth by operation of quick acting hydraulic cylinders 28 to move the brush 23 inwardly against the casting roll 12 or to retract it away from the casting roll 12. The roll mounting structure 27 may be in the form of a wide yoke with side wings 30 in which the brush shaft 25 is rotatably mounted in bearings 31. The brush 23, brush mounting structure 27 and actuator 28 may be carried on the main frame 20 of the brushing apparatus 21 so that the sweeper brush 23 will always be correctly positioned in advance of the cleaning main brush 22. The roll mounting structure 27 may also carry an elongate scraper blade 29 which extends throughout the width of the barrel brush 23 and projects into the canopy of bristles 26. Blade 29 may be made of hardened steel and have a sharp leading edge.

Figure 4:
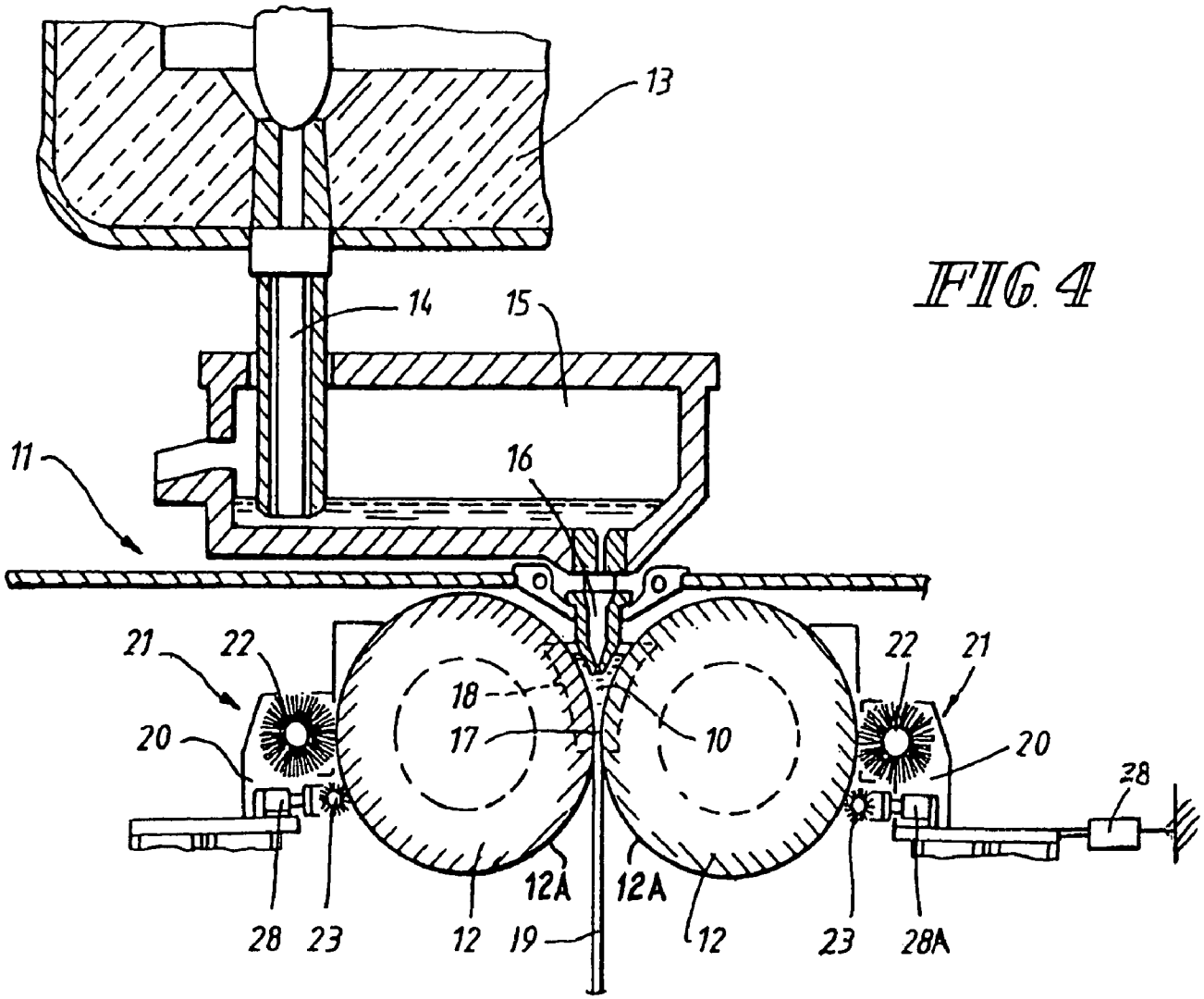
FIG. 4 illustrates a twin roll caster incorporating a pair of brushing apparatus in accordance with the invention.
Figure 8:
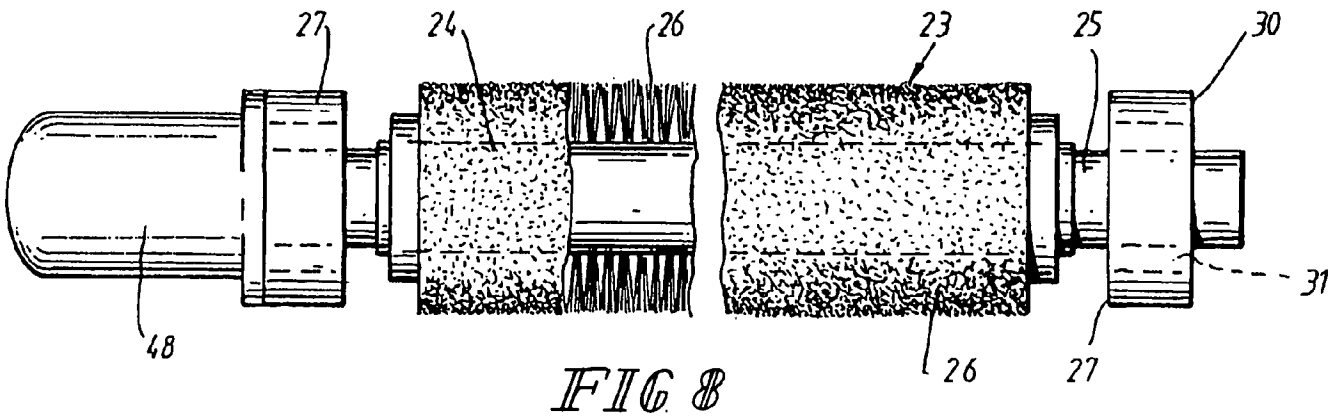
FIG. 8 is a front elevation of the sweeper brush in a modified apparatus in which the sweeper brush is positively driven by a drive motor.

Sweeper brush 23 may be rotated purely by frictional engagement between its canopy of bristles 26 with the casting roll 12, in which case it may be simply rotatably mounted between the side plates 42 of frame 20 without any drive to drive rotation as shown in FIG. 4. However, typically, the sweeper brush 23, if used, is positively driven by provision of a pneumatic, electric or hydraulic drive motor 48 as shown in FIG. 8.

With the arrangement shown in FIG. 4, sweeper brush 23 is biased inwardly against the casting roll 12 by actuation of the cylinder units 28 such that it is rotatably driven by the frictional engagement between the canopy of bristles 26 and the roll surface so that it is rotated in the opposite rotational (same peripheral) direction at the casting surface 12A at the region of its engagement with the casting surface, as indicated by the arrows 32, 33 in FIG. 5. The rotation of the sweeper brush 23 may be retarded by its inter-engagement with the scraper blade 29 so that the sweeper brush 23 is driven at a slower peripheral speed than casting roll 12. The relative speed between the roll and the barrel brush 23 may cause effective sweeping action and ensure that the bristles engaging the casting roll will change continuously. The scraper blade 29 also effectively cleans the sweeper brush 23 of contaminating material swept from the casting surface 12A of the casting roll 12 so that clean bristles are continuously presented to the casting roll 12 surface. A sweeper brush drive motor 48 may be provided as shown in FIG. 8, so that sweeper brush 23 can be positively driven at a fixed speed independent of the speed of the casting roll 12. It will generally be driven so that its bristles travel in the same rotational direction as the surface of the roll 12 but at a different (higher or lower) speed. The rotational speed of the sweeper brush 23 can be varied to optimize this speed differential.

Sweeper brush 23 is moved into contact with the casting surfaces 12A of the casting roll 12 prior to the start of casting and is moved away from the casting surfaces after casting conditions have stabilized. It is moved back into engagement with the casting surfaces just prior to termination of the cast. The point at which the casting conditions stabilize, and sweeper brush 23 disengaged from the casting surfaces, is usually about when the set point is reached for the level of the pool 10 of molten metal, and the point at which the sweeper brush 23 reengage is usually about when the set point level of the pool 10 is about to drop as the end of the casting run approaches. The sweeper brush 23 serves to prevent damage to the main brush 22 and the casting surface 12A of casting roll 12 due to carry over of debris generated on commencement and near termination of the casting run.

If clean bands are to be used in practicing the present method, before the casting campaign, each of casting rolls 12 are prepared with a clean band (not shown) before casting preferably at each end of the casting roll. This may be done by providing a chalk mark or soap stone mark on the casting surface 12A of the casting roll by rotating the casting rolls to make the mark along the circumferential surface. This chalk or soap stone mark may be positioned at each end of the casting roll 12 to ensure that the cold machine roll crown is not affected by creation of clean bands on the casting roll 12. In one embodiment, a clean band is positioned about 8 inches from each end of the casting roll and each band is about 15 millimeters in width. After the chalk or soap stone marks are formed on the casting roll surfaces, the cleaning brush 22 is applied to the casting surface 12A of the casting roll 12 as it is rotated to create the clean bands. The clean bands are characterized by a large central "clean area" with a feathered appearance toward the outside where the brush contact with the casting roll surfaces 12A becomes reduced. A clean band is the clean area formed by the contact of the brush 22 with the casting surface 12A, not including the feathered portions. During the subsequent casting campaign, the clean band(s) provide the reference for the energy to be exerted by the main brush 22 against the casting roll surfaces 12 to keep the casting roll surfaces clean in accordance with the present invention. This alternative is particularly used where the energy of the rotating brush exerted against the casting rolls during the casting campaign is controlled by an operator observing the casting surfaces of the casting rolls.

Figure 9:
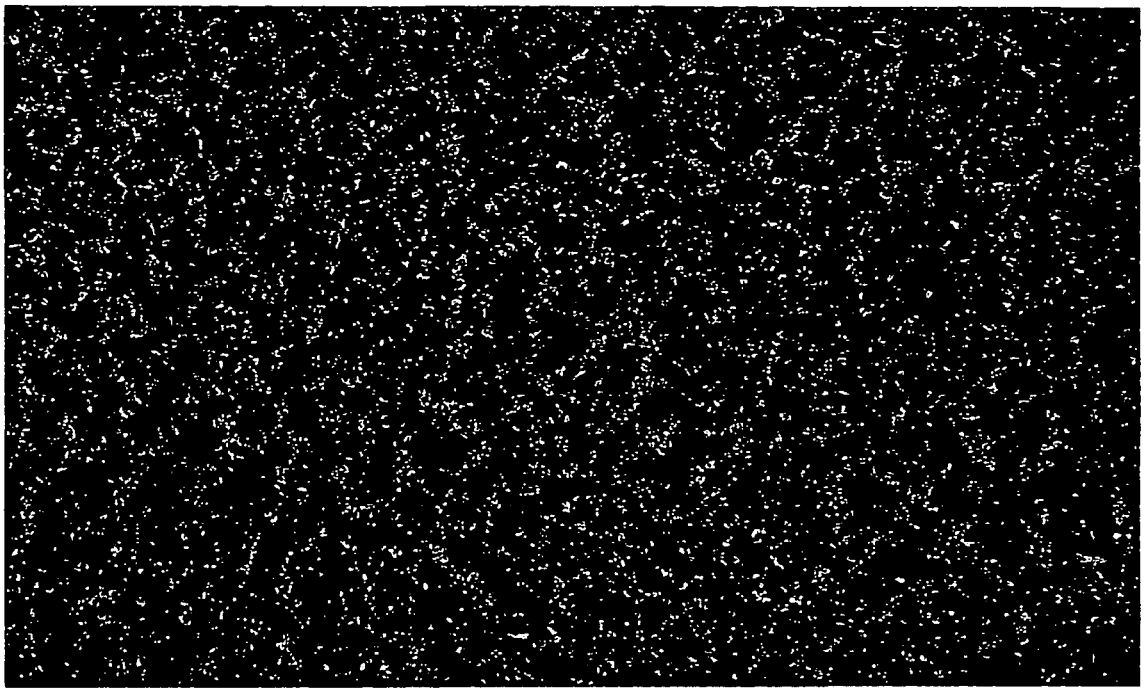
FIGS. 9 through 11 are micrographs showing textured casting roll surfaces cleaned in accordance with the present invention with the projections of the casting roll showing.
Figure 10:
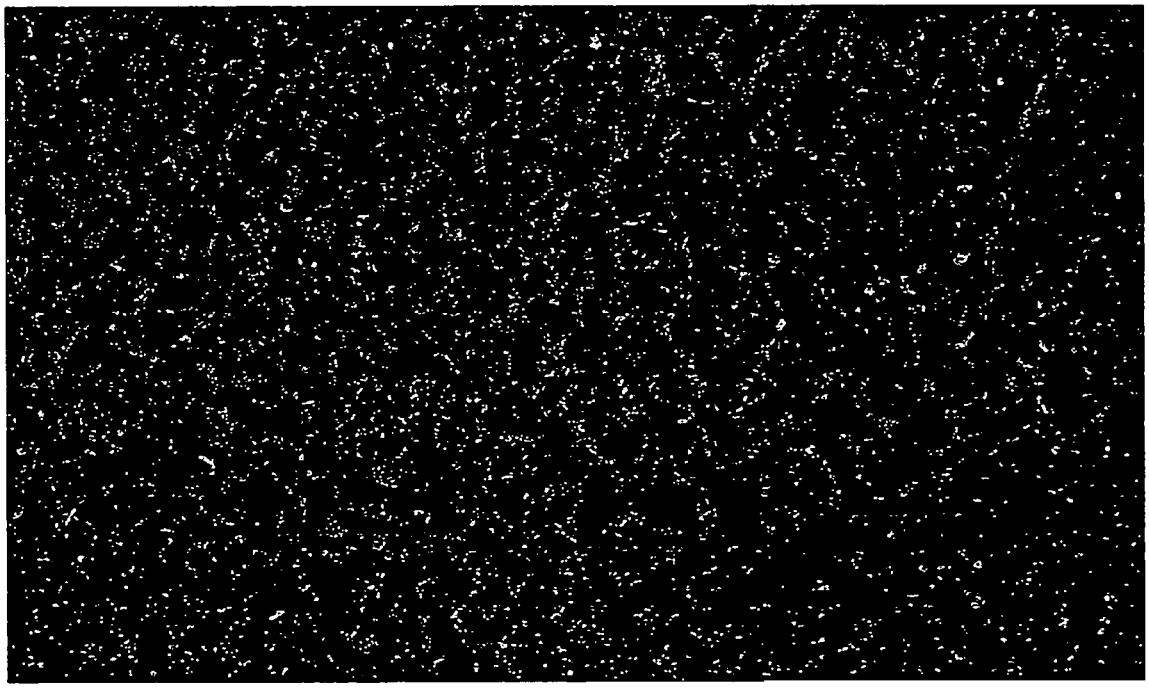
Figure 11:
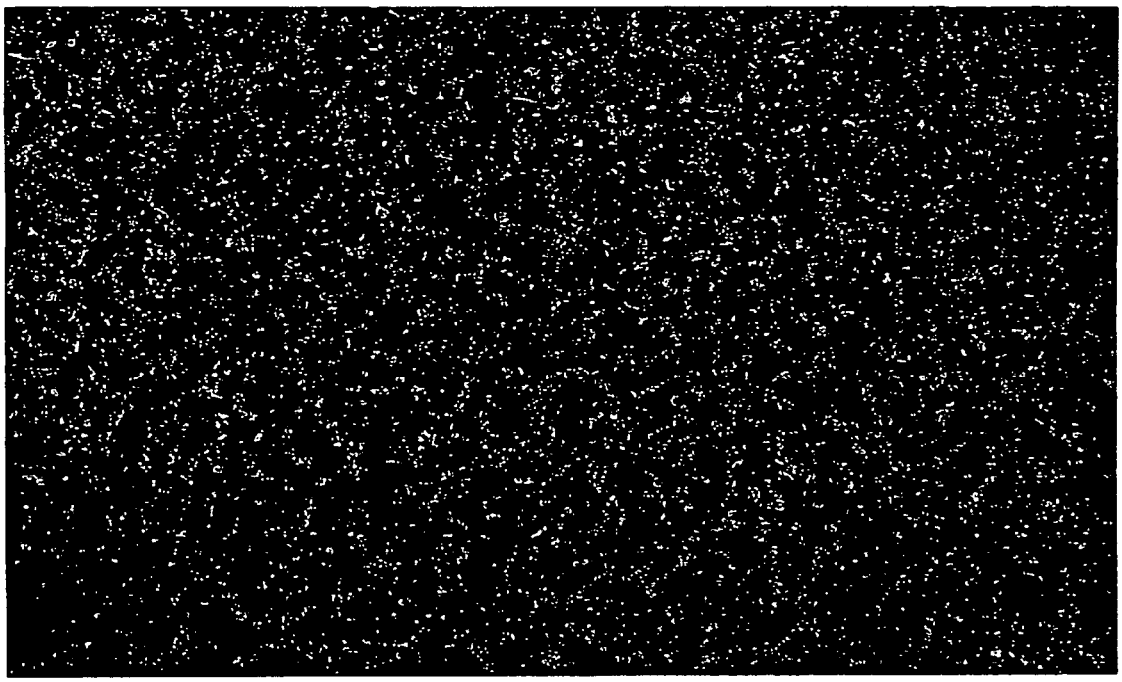

To illustrate the cleaning done in accordance with the present invention, micrographs of textured casting roll surfaces 12A are shown in FIGS. 9 through 11. As shown, the casting roll surfaces are not pristine clean. There is residuals in the low areas and entices in the casting surface, and not even all exposed projections of the casting roll surface are effectively clean. However, a substantial number of the projections are visible with exposed surfaces as shown, and are cleaned sufficiently that the formation of crocodile skin roughness is inhibited if or eliminated during casting. By rotating brushes cleaning the casting roll surfaces as shown in FIGS. 9-11, the casting roll surfaces 12A can be wetted by the molten metal in the casting pool 10, and heat flux can be effectively transmitted from the molten metal to the casting rolls when the casting surfaces are in contact with the casting pool while crocodile skin roughness is inhibited.

Figure 12:
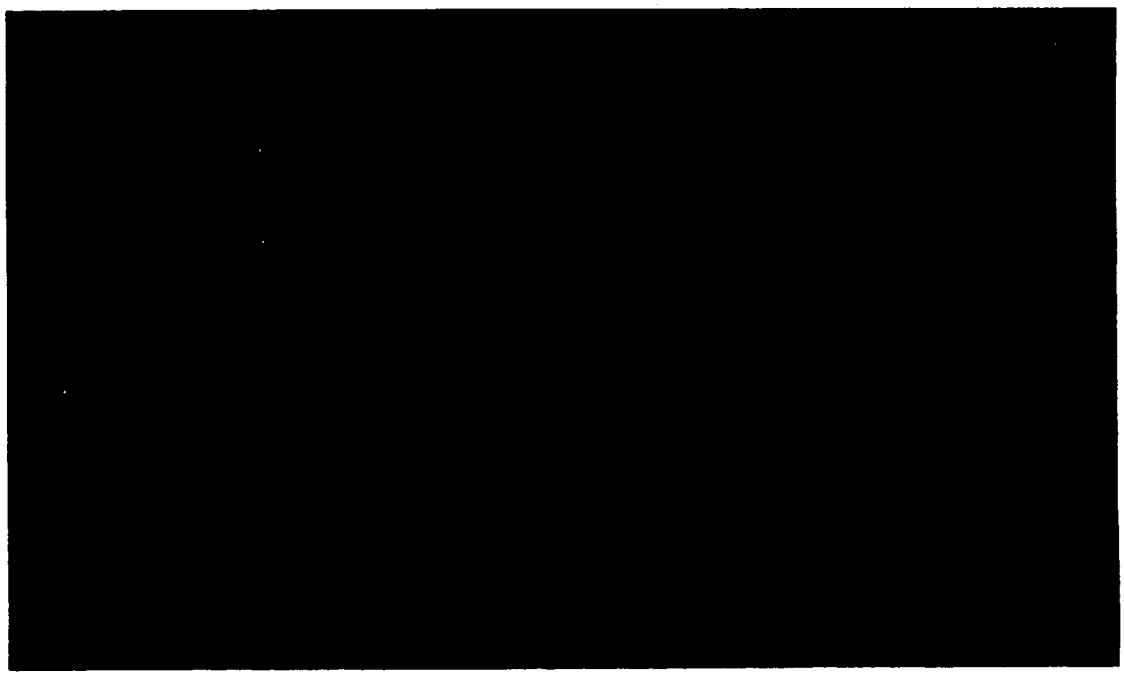
FIGS. 12 and 13 are photomicrographs of textured casting roll surfaces which were not properly cleaned in accordance with the present invention for purposes of illustration.
Figure 13:
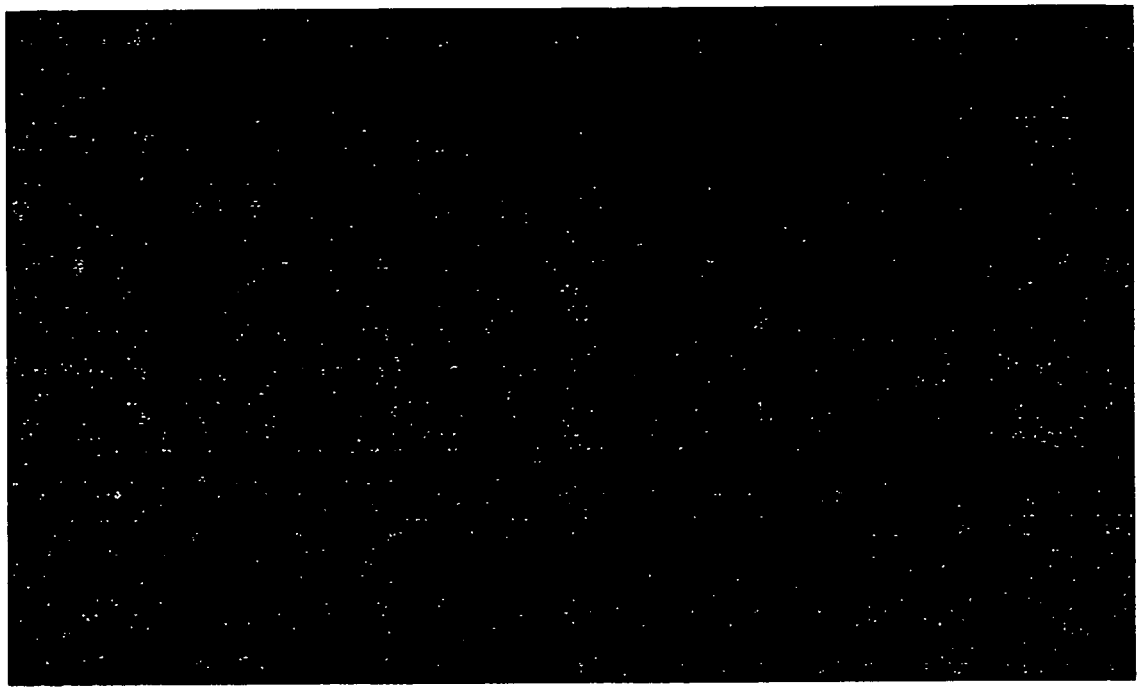

FIGS. 12 and 13 are provided for purposes of comparison. FIGS. 12 and 13 show where the projections of the textured casting roll surface 12A are "buried" beneath the molten melt and the casting surfaces are not exposed so that is effective heat flux from the molten metal to the casting roll surfaces in accordance with the present invention.

Figure 14:
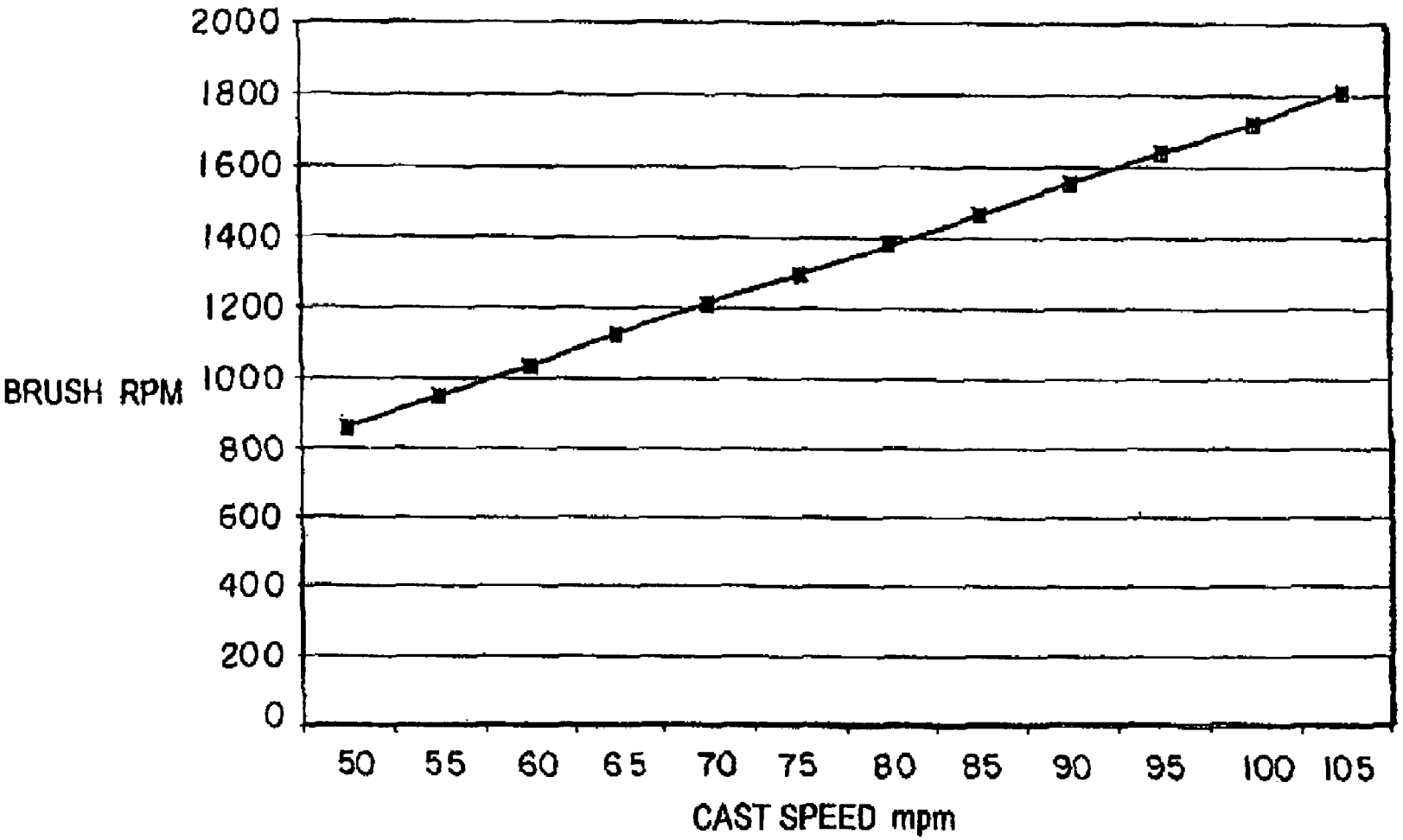
FIG. 14 is a graph showing the relationship between rotational speed of the sweeper brush and the casting speed of the caster.

We have also found that the cleaning efficiency requires maintaining a relationship between the rotational speed of the cleaning brush of the sweeper brush and the casting speed with the caster. FIG. 14 is a graph showing the relationship for a particular embodiment of the invention that has been built. Similar relationships can be empirically derived for other embodiments of the invention. This relationship provides for control of the energy of the brushes exerted against the casting surfaces to be maintained during the casting campaign.

Figure 15:
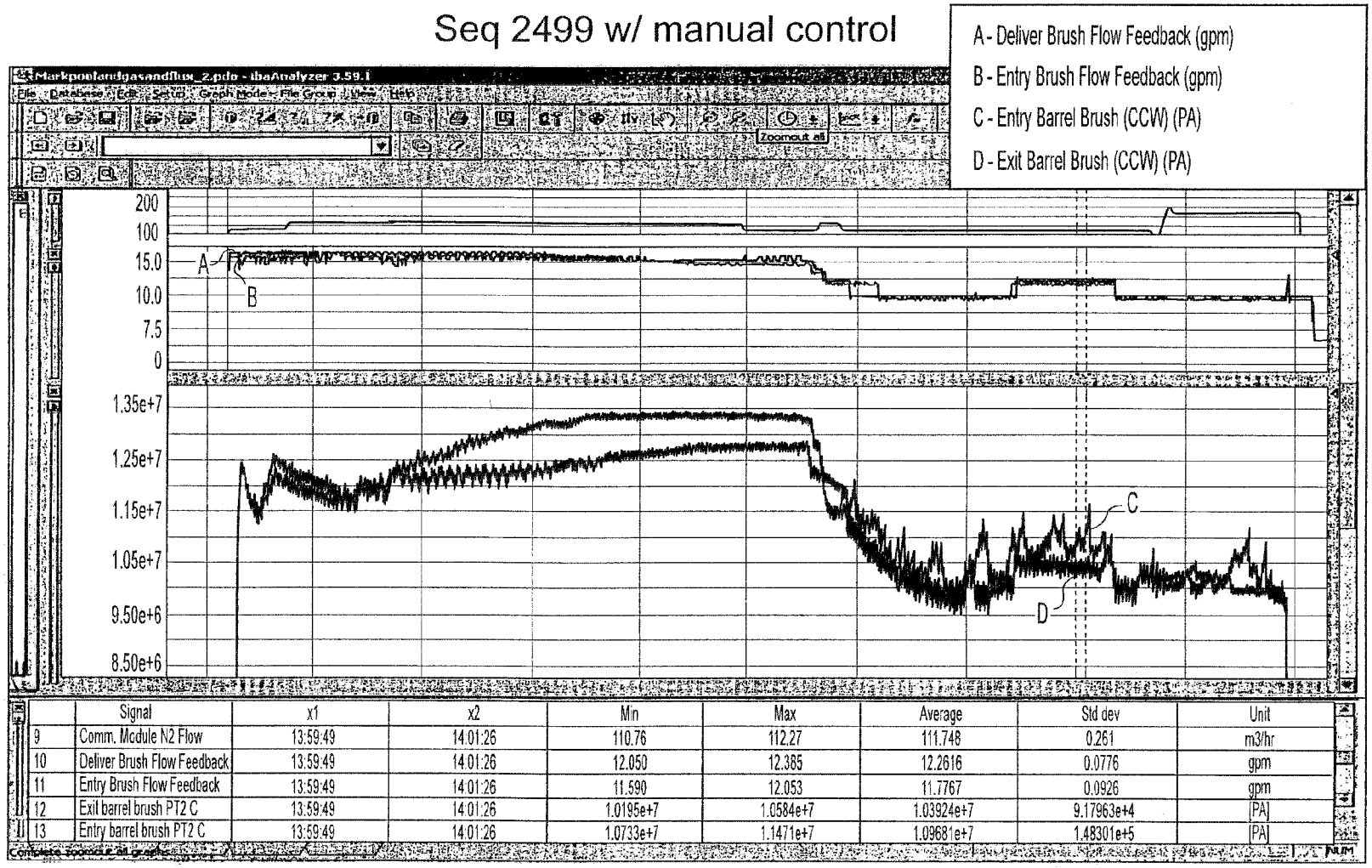
FIG. 15 is a plot of the hydraulic flow through hydraulic motors powering rotating brushes, as well as the differential in pressure of the hydraulic fluid across the hydraulic motors, with manual control.

Shown in FIG. 15 is the control of the energy exerted by the brushes on the casting surface to control the formation of crocodile skin roughness can be done by manually controlling the hydraulic fluid flow through the hydraulic motors and the pressure differential of hydraulic fluid across the hydraulic motors. FIG. 15 reports two ladle sequence 2499. In the upper part of FIG. 15 represented as 'A' and 'B,' the hydraulic fluid flow through the two hydraulic motors is reported in gallons per minute as flow feedback from the flow meter, and in the lower part of FIG. 15 represented as 'C' and 'D,' the hydraulic pressure differential of hydraulic fluid across the two hydraulic motors is reported in Pascals. As shown, the energy exerted by the brushes on the casting surfaces was maintained within tolerances over the two ladle sequence, although through the brush rotational speed and hydraulic pressure across the hydraulic motors tended to wonder downwardly toward the end on the sequence within tolerances.

Figure 16:
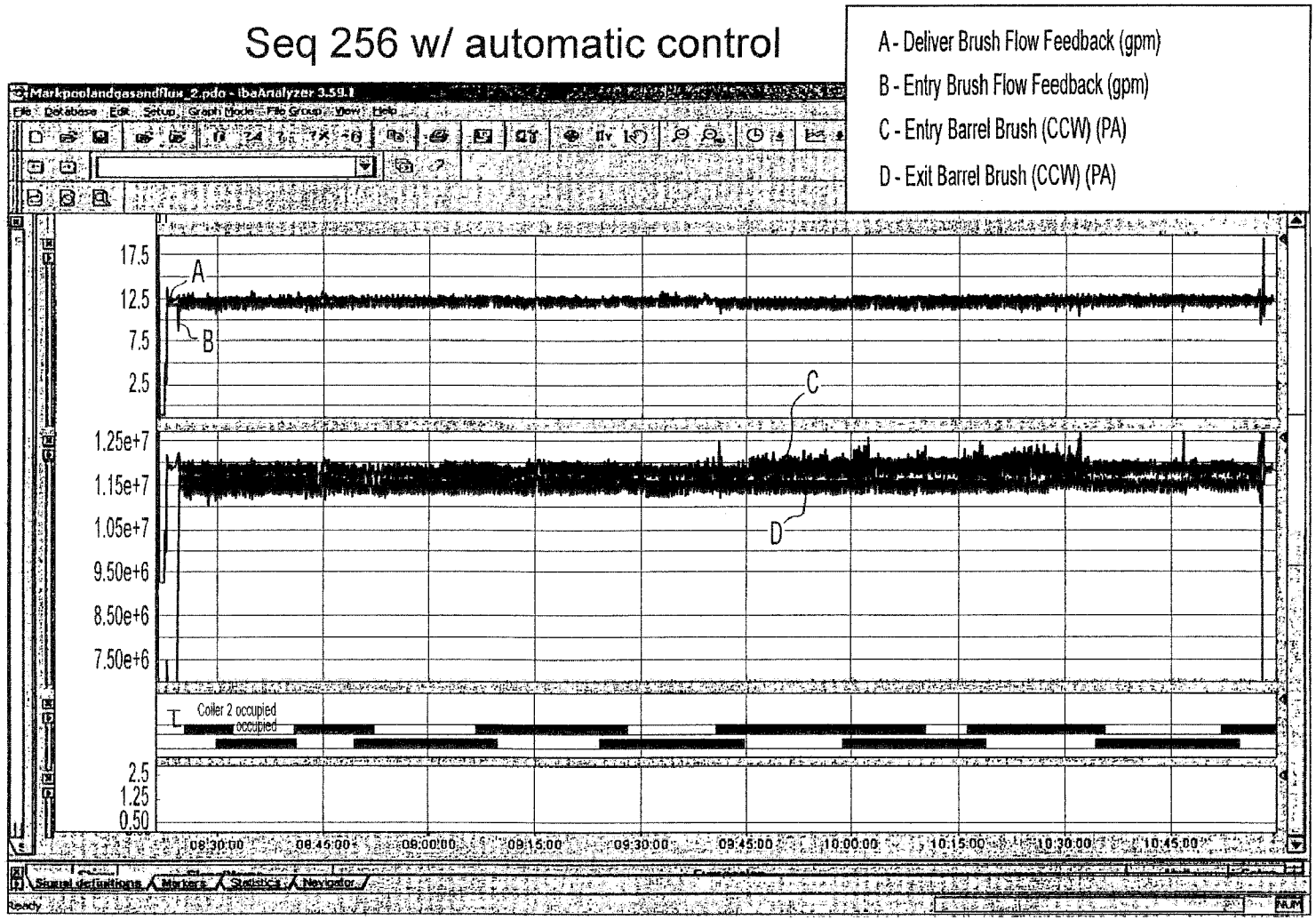
FIG. 16 is a plot of the hydraulic flow through hydraulic motors powering rotating brushes, as well as the differential in pressure of the hydraulic fluid across the hydraulic motors, with automated control.

Shown in FIG. 16 is the control of the energy exerted by the brushes on the casting surface to control the formation of crocodile skin roughness can be done by automated controls controlling the hydraulic fluid flow through the hydraulic motors and the pressure differential of hydraulic fluid across the hydraulic motors. FIG. 16 reports two ladle sequence 256. In the upper part of FIG. 16 represented as 'A' and 'B,' the hydraulic fluid flow through the two hydraulic motors is reported in gallons per minute as flow feedback from the flow meter, and in the lower part of FIG. 16 represented as 'C' and 'D,' the hydraulic pressure differential of hydraulic fluid across the two hydraulic motors is reported in Pascals. As shown, the energy exerted by the brushes on the casting surfaces was maintained very evenly over the two ladle sequence with the automated controls, and by contrast to FIG. 15, within closer tolerances than with the manual controls of the energy exerted by the brushes on the casting rolls.

Alternatively, the torque of the brush motor driving rotation of the cleaning brushes 22 and in turn the energy exerted by the cleaning brushes 22 against the respective casting surface of casting rolls 12 could be measured by strain gauges, load cell, or other device positioned adjacent the cleaning brush mounting structure or mounts for bearings 47 to measure the torque exerted by the cleaning brush 22 against the casting surfaces on the casting rolls.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Many modifications may be made to the present invention as described above without departing from the spirit and scope of the invention.

What is claimed is:

1. A method of controlling the formation of crocodile skin surface roughness in continuous casting of thin cast strip of plain carbon steel comprising the steps of:

assembling a pair of counter-rotating casting rolls laterally to form a nip between circumferential casting surfaces of the rolls through which metal strip may be cast;

forming a casting pool of molten metal of carbon steel of less than 0.065% by weight carbon supported on the casting surfaces of the casting rolls above the nip;

assembling a rotating brush peripherally to contact the casting surface of each casting roll in advance of contact of the casting surfaces with the molten metal in the casting pool;

forming a desired degree of cleaning of the casting surfaces of the casting rolls with a majority of projections on the casting surfaces exposed and provide wetting contact between the casting surface and the molten metal of the casting pool by controlling the energy exerted by the rotating brushes during a casting campaign;

controlling the energy exerted by the rotating brushes against the casting surfaces of the casting rolls using the desired degree of cleaning as a reference to expose a majority of projections of the casting surfaces of the casting rolls and provide wetting contact between the casting surface and the molten metal of the casting pool; and counter-rotating the casting rolls such that the casting surfaces of the casting rolls each travel toward the nip to produce a cast strip downwardly from the nip.

2. The method of controlling the formation of crocodile skin surface roughness in continuous casting of thin cast strip of plain carbon steel as claimed in claim 1 wherein:

the casting surfaces of the casting rolls are textured with projections.

3. The method of controlling the formation of crocodile skin surface roughness in continuous casting of thin cast strip of plain carbon steel as claimed in claim 1 wherein:

the energy of the rotating brush against the casting roll is controlled by varying the applied pressure of the brush against the casting surface of the casting roll.

4. The method of controlling the formation of crocodile skin surface roughness in continuous casting of thin cast strip of plain carbon steel as claimed in claim 1 wherein:

the energy of the rotating brush against the casting roll is controlled by varying the rotation speed of the brush against the casting surface of the casting roll.

5. The method of controlling the formation of crocodile skin surface roughness in continuous casting of thin cast strip of plain carbon steel as claimed in claim 1 wherein:

the energy of the rotating brush against the casting roll is controlled by varying the pressure applied by the brush against the casting roll surface of the casting roll and varying the rotation speed of the brush against the casting surface of the casting roll.

6. The method of controlling the formation of crocodile skin surface roughness in continuous casting of thin east strip of plain carbon steel as claimed in claim 1 wherein:

the casting surfaces of the casting rolls are textured with a random distribution of discrete projections.

7. The method of controlling the formation of crocodile skin surface roughness in continuous casting of thin cast strip of plain carbon steel as claimed in claim 1 wherein:

the energy is automatically controlled by automated controls during a casting campaign.

8. A method of controlling the formation of crocodile skin surface roughness in continuous casting of thin cast strip of plain carbon steel comprising the steps of:

assembling a pair of counter-rotating casting rolls laterally to form a nip between circumferential casting surfaces of the rolls through which metal strip may be cast;

forming a casting pool of molten metal of carbon steel of less than 0.065% by weight carbon supported on the casting surfaces of the casting rolls above the nip;

assembling a rotating brush using hydraulic motors peripherally to contact the casting surface of each casting roll in advance of contact of the casting surfaces with the molten metal in the casting pool;

forming a desired degree of cleaning of the casting surfaces of the casting rolls with a majority of projections on the casting surfaces exposed and provide wetting contact between the casting surface and the molten metal of the casting pool by controlling the energy exerted by the rotating brushes during a casting campaign;

monitoring the torque of the hydraulic motors to control the energy exerted by the rotating brushes against the casting surfaces of the casting rolls using the desired degree of cleaning as a reference to clean to expose a majority of projections of the casting surfaces of the casting rolls and provide wetting contact between the casting surface and the molten metal of the casting pool; and counter-rotating the casting rolls such that the casting surfaces of the casting rolls each travel toward the nip to produce a cast strip downwardly from the nip.

9. The method of controlling the formation of crocodile skin surface roughness in continuous casting of thin cast strip of plain carbon steel as claimed in claim 8 wherein:

the torque of the hydraulic motors is monitored by measuring the pressure differential of hydraulic fluid between inlet and outlet through the hydraulic motors.

10. The method of controlling the formation of crocodile skin surface roughness in continuous casting of thin cast strip of plain carbon steel as claimed in claim 8 wherein:

the torque of the hydraulic motors is monitored by measuring the torque between the hydraulic motor and a chock or a motor mount.

11. The method of controlling the formation of crocodile skin surface roughness in continuous casting of thin cast strip of plain carbon steel as claimed in claim 8 wherein:

the casting surfaces of the casting rolls are textured with projections.

12. The method of controlling the formation of crocodile skin surface roughness in continuous casting of thin cast strip of plain carbon steel as claimed in claim 8 wherein:

the energy of the rotating brush against the casting roll is also controlled by varying the rotation speed of the brush against the casting surface of the casting roll.

13. The method of controlling the formation of crocodile skin surface roughness in continuous casting of thin cast strip of plain carbon steel as claimed in claim 8 wherein:

the casting surfaces of the casting rolls are textured with a random distribution of discrete projections.

14. The method of controlling the formation of crocodile skin surface roughness in continuous casting of thin cast strip of plain carbon steel as claimed in claim 8 wherein:

the energy is automatically controlled by automated controls during a casting campaign.

15. A method of controlling the formation of crocodile skin surface roughness in continuous casting of thin cast strip of plain carbon steel comprising the steps of:

assembling a pair of counter-rotating casting rolls laterally to form a nip between circumferential casting surfaces of the rolls through which metal strip may be cast;

forming a casting pool of molten metal of less than 0.065% by weight carbon supported on the casting surfaces of the casting rolls above the nip;

assembling a rotating brush peripherally to contact the casting surface of each casting roll in advance of contact of the casting surfaces with the molten metal;

forming at least one clean band with a majority of projections on the casting surfaces exposed to provide as reference for controlling the pressure exerted by the rotating brushes against the casting surfaces of the casting rolls;

controlling the energy of the rotating brush against the casting rolls using the clean band as a reference; and counter-rotating the casting rolls such that the casting surfaces of the casting rolls each travel toward the nip to produce a cast strip downwardly from the nip.

16. The method of controlling the formation of crocodile skin surface roughness in continuous casting of thin cast strip of plain carbon steel as claimed in claim 15 wherein:

the casting roll has a clean band adjacent each end of the casting roll.

17. The method of controlling the formation of crocodile skin surface roughness in continuous casting of thin cast strip of plain carbon steel as claimed in claim 15 wherein:

the casting surfaces of the casting rolls are textured with a random distribution of discrete projections.

18. The method of controlling the formation of crocodile skin surface roughness in continuous casting of thin cast strip of plain carbon steel as claimed in claim 15 wherein:

the energy of the rotating brush against the casting roll is controlled by varying the applied pressure of the brush against the casting surface of the casting roll.

19. The method of controlling the formation of crocodile skin surface roughness in continuous casting of thin cast strip of plain carbon steel as claimed in claim 15 wherein:

the energy of the rotating brush against the casting roll is controlled by varying the rotation speed of the brush against the casting surface of the casting roll.

20. The method of controlling the formation of crocodile skin surface roughness in continuous casting of thin cast strip of plain carbon steel as claimed in claim 15 wherein:

the energy of the rotating brush against the casting roll is controlled by varying the pressure applied by the brush against the casting roll surface of the casting roll and varying the rotation speed of the brush against the casting surface of the casting roll.

21. The method of controlling the formation of crocodile skin surface roughness in continuous casting of thin cast strip of plain carbon steel as claimed in claim 15 wherein:

the energy is automatically controlled by automated controls during a casting campaign.

22. A method of controlling the formation of crocodile skin surface roughness in continuous casting of thin cast strip of plain carbon steel comprising the steps of:

assembling a pair of counter-rotating casting rolls laterally to form a nip between circumferential casting surfaces of the rolls through which metal strip may be cast;

forming a casting pool of molten metal of plain carbon steel of less than 0.065% by weight carbon supported on the casting surfaces of the casting rolls above the nip;

assembling a rotating brush peripherally to contact the casting surface of each casting roll in advance of contact of the casting surfaces with the molten metal capable of cleaning residual from the surface of the casting roll;

cleaning to expose a majority of projections of the casting surfaces of the casting rolls and measuring the heat flux from molten metal with the cleaned casting surfaces;

continually measuring the heat flux from the molten metal to the casting surfaces of the casting rolls;

controlling the energy of the rotating brush against the casting surface of the casting roll based on the difference between said measured heat flux and an initially measured heat flux between the molten metal and the casting surface; and counter-rotating the casting rolls such that the casting surfaces of the casting rolls each travel toward the nip to produce a cast strip downwardly from the nip.

23. The method of controlling the formation of crocodile skin surface roughness in continuous casting of thin cast strip of plain carbon steel as claimed in claim 22 wherein:

the energy of the rotating brush against the casting roll is controlled by varying the applied pressure of the brush against the casting surface of the casting roll.

24. The method of controlling the formation of crocodile skin surface roughness in continuous casting of thin cast strip of plain carbon steel as claimed in claim 22 wherein:

the energy of the rotating brush against the casting roll is controlled by varying the rotation speed of the brush against the casting surface of the casting roll.

25. The method of controlling the formation of crocodile skin surface roughness in continuous casting of thin cast strip of plain carbon steel as claimed in claim 22 wherein:

the energy of the rotating brush against the casting roll is controlled by varying the pressure applied by the brush against the casting roll surface of the casting roll and varying the rotation speed of the brush against the casting surface of the casting roll.

26. The method of controlling the formation of crocodile skin surface roughness in continuous casting of thin cast strip of plain carbon steel as claimed in claim 22 wherein:

the energy of the rotating brush against the casting roll is measured by measuring the torque of a motor rotating the brush.

27. The method of controlling the formation of crocodile skin surface roughness in continuous casting of thin cast strip of plain carbon steel as claimed in claim 22 wherein:

the applied pressure of the rotating brush against the casting roll is measured by measuring the torque of a motor rotating the brush.

28. The method of controlling the formation of crocodile skin surface roughness in continuous casting of thin cast strip of plain carbon steel as claimed in claim 22 wherein:

the rotation speed of the rotating brush against the casting roll is measured by measuring the torque of a motor rotating the brush.

29. The method of controlling the formation of crocodile skin surface roughness in continuous casting of thin cast strip of plain carbon steel as claimed in claim 22 wherein:

the pressure and rotation speed of the rotating brush against the casting roll are measured by measuring the torque of a motor rotating the brush.

30. The method of controlling the formation of crocodile skin surface roughness in continuous casting of thin cast strip of plain carbon steel as claimed in claim 22 wherein:

the energy is automatically controlled by automated controls during a casting campaign.

31. The method of controlling the formation of crocodile skin surface roughness in continuous casting of thin cast strip of plain carbon steel as claimed in claim 22 comprising in addition the step of:

controlling pressure of gas blown against the casting surface of the casting roll based on the difference between said measured heat flux and an initially measured heat flux between the molten metal and the casting surfaces to assist in controlling the formation of crocodile skin surface roughness in continuous casting of thin-cast strip.

* * * * *